US007634918B2

(12) United States Patent
Kawaguchi et al.

(10) Patent No.: US 7,634,918 B2
(45) Date of Patent: Dec. 22, 2009

(54) REFRIGERATOR HAVING USER-CONTROLLED FUNCTIONS

(75) Inventors: Tomoki Kawaguchi, Bonita, CA (US); Kunimitsu Ozaki, Bonita, CA (US)

(73) Assignee: Sanyo E & E Corporation, San Diego ( * ) Notice: Subject to any disclaimer, the term of this patent is extended or adjusted under 35 U.S.C. 154(b) by 596 days.

(21) Appl. No.: 11/176,542

(22) Filed: Jul. 7, 2005

(65) Prior Publication Data

US 2008/0295529 A1 Dec. 4, 2008

(51) Int. Cl.
*F25B 49/00* (2006.01)

(52) U.S. Cl. ..... 62/126; 62/157; 62/228.1; 62/229

(58) Field of Classification Search ..... 62/126, 62/157, 228.1, 229, 231
See application file for complete search history.

(56) References Cited

U.S. PATENT DOCUMENTS

| | | | | |
|---|---|---|---|---|
| 3,631,685 | A | 1/1972 | Young | |
| 3,759,053 | A | 9/1973 | Swaneck, Jr. | |
| 4,448,346 | A * | 5/1984 | Kuwaki et al. | 236/46 R |
| 4,959,969 | A | 10/1990 | Okamoto et al. | |
| 5,816,059 | A * | 10/1998 | Ficchi et al. | 62/127 |
| 6,393,848 | B2 * | 5/2002 | Roh et al. | 62/126 |
| 6,549,866 | B1 | 4/2003 | Bhatnagar | |
| 6,564,568 | B1 | 5/2003 | Shen | |
| 6,584,786 | B2 | 7/2003 | Tavolazzi | |
| 6,729,147 | B2 | 5/2004 | Lee | |
| 2001/0045096 | A1 * | 11/2001 | Tatter | 62/129 |
| 2003/0009610 | A1 | 1/2003 | Nolan et al. | |
| 2003/0109938 | A1 | 6/2003 | Daum et al. | |
| 2003/0149576 | A1 | 8/2003 | Sunyich | |

FOREIGN PATENT DOCUMENTS

KR 2001060676 A * 7/2001

OTHER PUBLICATIONS

"ThermoKool MR-138 Product Description".
"Norcold N300 Product Description".
"Cooper Cooler Product Description".

* cited by examiner

*Primary Examiner*—Marc E Norman
(74) *Attorney, Agent, or Firm*—Masuvalley & Partners

(57) ABSTRACT

A refrigeration device may provide a snooze feature, in which the compressor of the refrigeration device is turned off for a predetermined period of time in response to a user command. The refrigeration device may also provide a quick chill feature, in which the compressor of the refrigeration device is turned on for a predetermined period of time in response to a user command. User commands for controlling the operation of the refrigeration device may be provide through a control panel, a remote control or a network interface.

16 Claims, 10 Drawing Sheets

REFRIGERATOR HAVING USER-CONTROLLED FUNCTIONS

BACKGROUND

1. Field of the Invention

Embodiments of the invention relate to refrigeration devices, and in particular to user-control of refrigerator functions.

2. Related Technology

FIG. 1 shows a schematic diagram of a conventional refrigeration device. The device has an interior space 10 that is maintained at a desired temperature by a cooling system comprised of a compressor 12 and coils 14. The compressor 12 compresses a coolant gas into a liquid state. The liquid is then circulated to the coils 14, where it is allowed to expand to a gaseous state, thus removing heat from the coils and the surrounding atmosphere. A control system is used to control the operation of the compressor 12. The control system is comprised of a power controller 16 that controls the supply of power to the compressor 12 to turn the compressor 12 on or off. The power controller 16 may comprise a relay and associated circuitry. A temperature detector 18 such as a thermistor is located in the interior of the refrigeration device and provides a signal that is representative of the interior temperature to the power controller 16. A temperature selector 20 such as a variable resistor is also located in the interior of the refrigeration device and supplies a signal to the power controller. The temperature selector 20 is user operable and allows the user to specify a target temperature at which the interior is to be maintained. The power controller 16 switches the compressor between on and off states in response to the signals from the temperature detector 18 and the temperature selector 20. This method of operation is shown in FIG. 2 and is referred to herein as thermostat control. The control system is typically designed to provide a degree of hysteresis so that the cooling system is not constantly switched between on and off states in response to minor fluctuations around the target temperature. Some refrigerators further include an on/off switch that enables the user to shut off the compressor without the need to unplug the refrigerator from its power supply.

SUMMARY

Embodiments of the invention relate to the control systems of refrigeration devices and to user controlled functions of those control systems.

One feature that may be provided in embodiments of the invention is a user-controlled "snooze" function by which the user is enabled to turn off the compressor of the refrigeration device for a predetermined period of time or for a period of time chosen by the user. This function enables the user to silence the refrigeration device for a period of time without unplugging the refrigeration device. For example, a hotel guest may choose to place the hotel room refrigerator into snooze mode overnight so as not to disturb the guest's sleep. The control system of a refrigeration device providing this feature may be implemented using discrete logic elements, a hybrid circuit, an integrated circuit, or a microcontroller. User control signals may be supplied through control panel switches, a remote control, or a network interface.

Another feature that may be provided in embodiments of the invention is a user-controlled "quick chill" function by which the user is enabled to turn on the compressor of the refrigeration device for a predetermined period of time or for a period of time chosen by the user. This function enables the user to run the refrigeration device continuously for a period of time to cool objects within the device as quickly as possible without the typical on/off compressor cycle that conventional refrigeration devices undergo even when set to the lowest possible target temperature. For example, a hotel guest may choose to place the hotel room refrigerator into quick chill mode upon arriving at a hotel room in order to rapidly cool food or beverages placed in the refrigerator. The control system of a refrigeration device providing this feature may be implemented using discrete logic elements, a hybrid circuit, an integrated circuit, or a microcontroller. User control signals may be supplied through control panel switches, a remote control, or a network interface.

The aforementioned snooze and quick chill features may be implemented in a refrigeration device individually or together. These features may be implemented in all manner of refrigeration devices including home refrigerators, small capacity refrigerators such as hotel room refrigerators, and commercial or industrial refrigeration devices.

In accordance with one embodiment, a refrigeration device has a control system for controlling a compressor of the refrigeration device. The control system is switchable among at least three states in response to user commands, including a thermostat control state in which the compressor is turned on and off to maintain the interior of the refrigeration device near a target temperature, an off state in which the compressor is maintained continuously off for a first predetermined period of time, and an on state in which the compressor is maintained continuously on for a predetermined period of time. The control system may include a control logic circuit that provides a control signal for controlling the state of the compressor, a temperature detector located in the interior of the refrigeration device that provides a temperature detector signal to the control logic circuit, and a control panel having a first switch corresponding to the off state and a second switch corresponding to the on state, with the first switch and the second switch providing respective signals to the control logic circuit. Alternatively, the control system may include a programmable controller that provides a control signal for controlling the state of the compressor, a temperature detector providing a signal to the programmable controller representing the interior temperature of the refrigeration device, a temperature selector providing a signal to the microcontroller representing an target temperature for the thermostat control mode, and a control panel having a first switch corresponding to the off state and a second switch corresponding to the on state, the first switch and the second switch providing respective signals to the programmable controller.

In accordance with another embodiment, a method for controlling the operation of a compressor in a refrigeration device may include executing a thermostat control mode in which the compressor is turned on and off in accordance with a target temperature and a detected interior temperature of the refrigeration device, receiving a user command, turning the compressor off for a predetermined period of time in response to the user command.

In accordance with another embodiment, a method for controlling the operation of a compressor in a refrigeration device may include executing a thermostat control mode in which the compressor is turned on and off in accordance with a target temperature and a detected interior temperature of the refrigeration device, receiving a user command, and turning the compressor on for a predetermined period of time in response to the user command.

Many additional features and alternatives are discussed in the following detailed description and the corresponding drawings.

DETAILED DESCRIPTION

Figure 3:
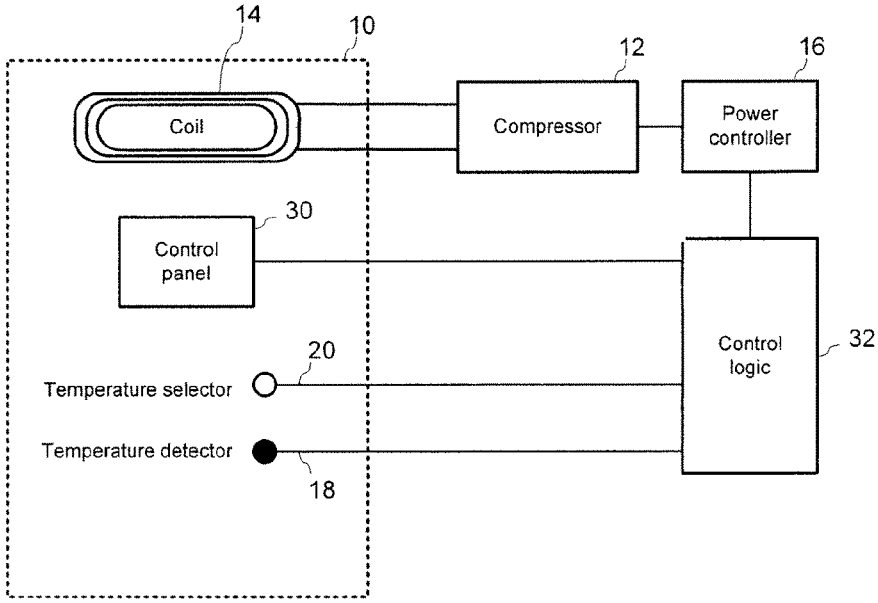
FIG. 3 shows a schematic diagram of a first refrigeration device in accordance with the invention.

FIG. 3 shows a schematic diagram of a first refrigeration device in accordance with the invention. The refrigeration device includes a cooling system comprised of a compressor 12 and coils 14 for cooling the interior space 10 of the refrigeration device. A control system of the refrigeration device includes a power controller 16, a temperature detector 18 and a temperature selector 20. The power controller 16 may be implemented as a relay or other electrical element that is capable of delivering adequate electrical power to the compressor and that is switchable between on and off states. The temperature detector 18 may be implemented as a thermistor or other temperature responsive electronic element that supplies a signal or has an electronic characteristic corresponding to the sensed temperature. The temperature selector 20 may be implemented as a variable resistor or other electronic element having a user controllable parameter to provide a signal corresponding to a desired target temperature.

Figure 1:
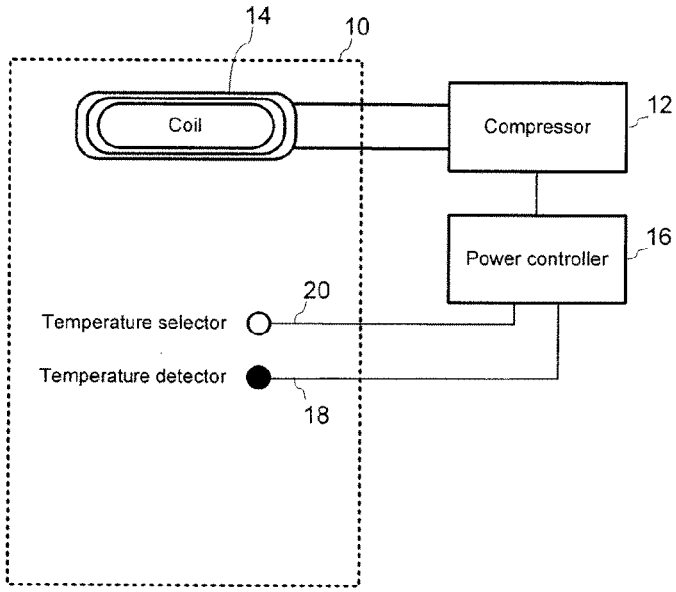
Figure 1 Prior Art
FIG. 1 shows a schematic diagram of a conventional refrigeration device.
Figure 2:
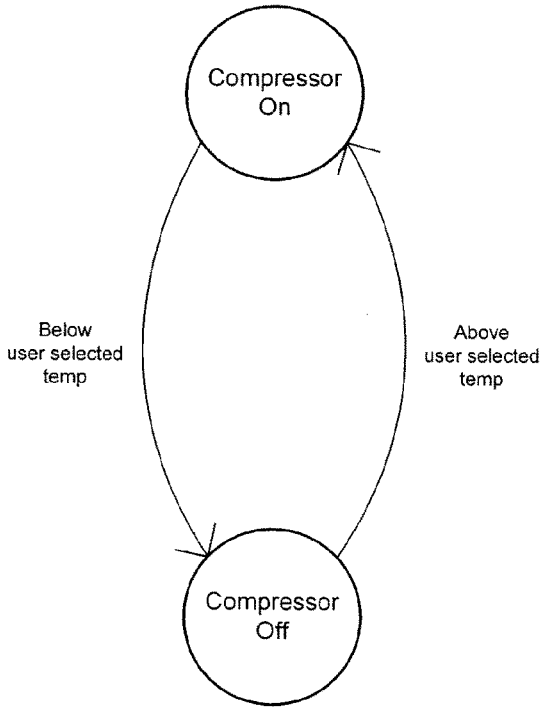
Figure 2 Prior Art
FIG. 2 shows a state diagram for the control system of a conventional refrigeration device.

The control system of the refrigeration device of FIG. 3 further includes a control panel 30 and a control logic circuit 32. The control logic circuit 32 receives signals from the temperature detector 18, the temperature selector 20, and the control panel 30, and provides a control signal to the power controller 16 to control the on/off state of the compressor 12. The control logic circuit 32 provides user-selectable compressor operation in any of three modes: conventional thermostat control of the type shown in FIG. 2; "snooze" mode, in which the compressor is maintained in an off state for a predetermined period of time; and "quick chill" mode, in which the compressor is maintained in an on state for a predetermined period of time.

Figure 4:
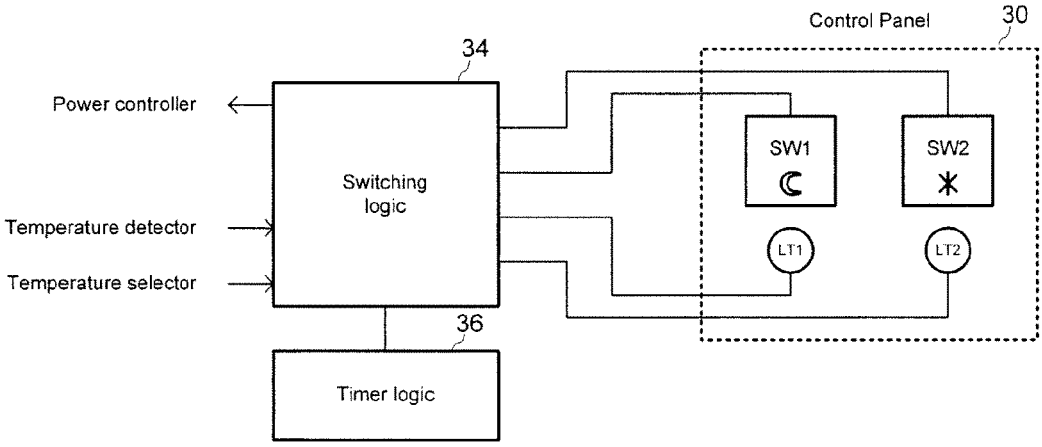
FIG. 4 shows details of a control system of the first refrigeration device.

Details of the control panel 30 and control logic circuit 32 are illustrated in FIG. 4. The control panel 30 includes a first switch SW1 and a second switch SW2 that are operable by the user to select a mode of operation of the refrigeration device. The switches may be, for example, touch sensitive switches, push button switches, or other types of switching apparatus that enable the user to operate the switch through physical contact. Each switch is associated with one of the aforementioned snooze and quick chill modes of operation. For purposes of illustration, the snooze mode switch is indicated in the drawings by a crescent moon icon, and the quick chill switch is indicated in the drawings by a snowflake icon. Associated with each switch is a respective light LT1, LT2 that indicates the mode in which the refrigeration device is operating. The lights may be implemented as LEDs or other light emitting devices and may be integral with the switches or separate from them.

The control logic circuit is comprised of a switching logic circuit 34 and a timer logic circuit 36. The timer logic circuit 36 includes timing elements that perform a timing function and provide a timeout signal after the passage of a predetermined period of time from the initiation of the timing function. The switching logic circuit 34 receives signals from the switches SW1, SW2, the temperature detector 18, the temperature selector 20, and the timer logic circuit 36, and supplies signals to the power controller 16, the timer logic circuit 36, and the control panel lights LT1, LT2. The switching logic circuit 34 and timing logic circuit 36 may be implemented using discrete elements such as transistor switches, relays, clock generators, pulse counters, latches, logic gates and other digital logic elements that are coupled to and interconnected via a printed circuit board. Alternatively the control logic circuit 32 may be implemented as an integrated circuit having such elements integrated on a single circuit substrate, or a hybrid circuit comprised of a combination of integrated circuits and discrete elements.

Figure 5:
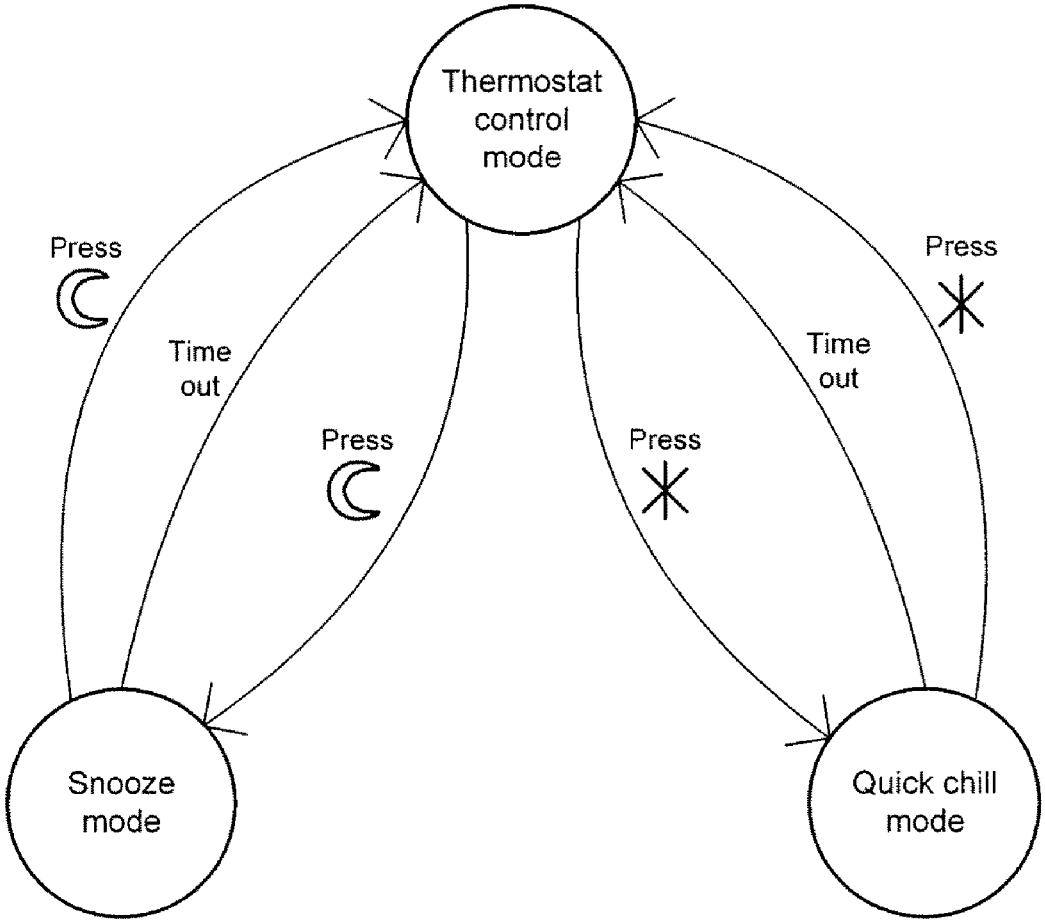
FIG. 5 shows a first state diagram that may be implemented by the control system of FIG. 4.

FIG. 5 shows a first state diagram that may be implemented by the control panel and control logic circuit of FIGS. 3 and 4. In this state diagram, the refrigeration device is switchable between three modes: the thermostat control mode, in which the compressor is controlled in accordance with a target temperature and a detected temperature; the snooze mode, in which the compressor is maintained in an off state for a predetermined period of time; and the quick chill mode, in which the compressor is maintained in an on state for a predetermined period of time. In this control scheme, the thermostat control mode is the default mode of operation of the device upon being powered up. As shown in the state diagram, when in thermostat control mode, the snooze mode may be entered by pressing the snooze button on the control panel. This causes the control logic to initiate the operation of a timer and, in the absence of further operation of the control panel switches, to maintain the compressor in an off state until the timer provides a timeout signal. The length of the timer in the snooze mode is preferably eight hours. The snooze mode may be terminated before timeout by user operation of the snooze mode switch on the control panel, which returns the device to thermostat control mode. The light associated with the snooze mode switch is illuminated by the control logic when the device is in snooze mode.

Similarly, the quick chill mode may be entered when in thermostat control mode by pressing the quick chill button on the control panel. This causes the control logic to initiate the operation of a timer and, in the absence of further operation of the control panel switches, to maintain the compressor in an on state until the timer provides a timeout signal. The length of the timer in the quick chill mode is preferably two hours. The quick chill mode may be terminated before timeout by user operation of the quick chill switch on the control panel, which returns the device to thermostat control mode. The light associated with the quick chill mode switch is illuminated by the control logic when the device is in quick chill mode.

Figure 6:
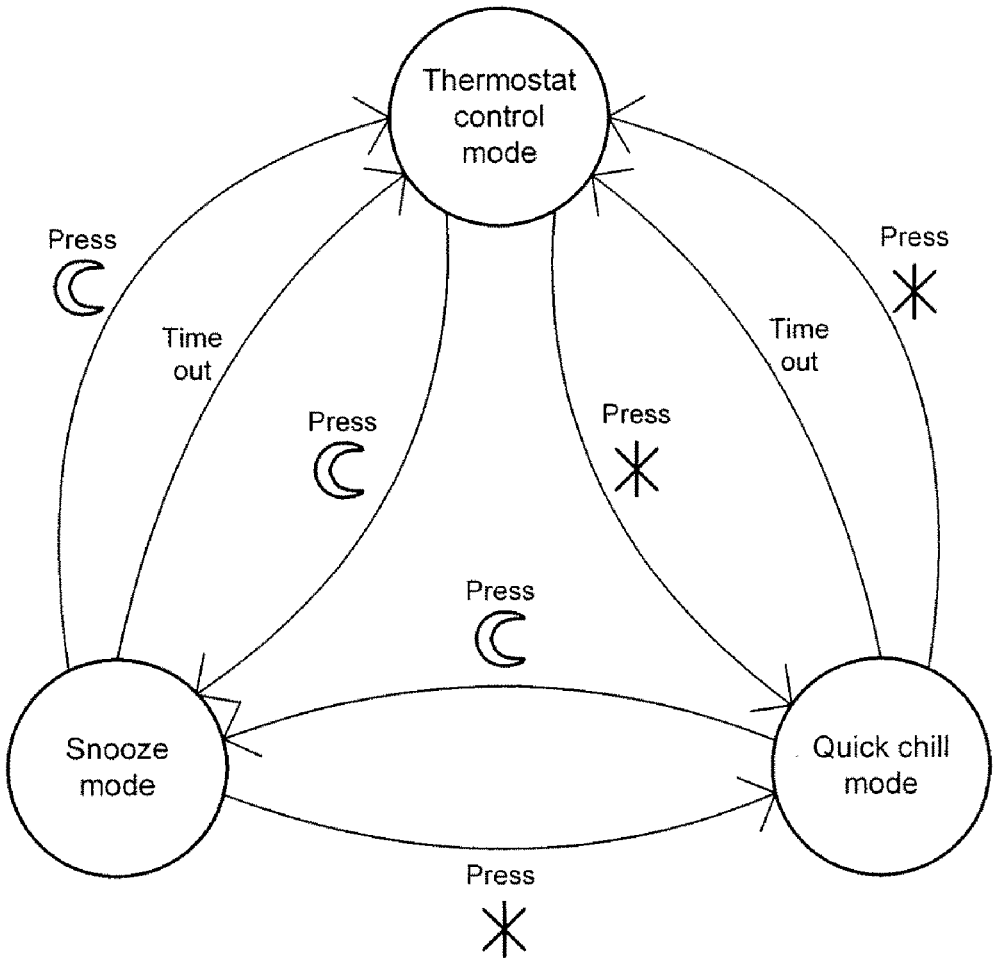
FIG. 6 shows a second state diagram that may be implemented by the control system of FIG. 4.

FIG. 6 shows a second state diagram that may be implemented by the control panel and control logic circuit of FIGS. 3 and 4. This state diagram provides the functionality illustrated in the state diagram of FIG. 5, and adds the additional functionality of direct transitions between the snooze mode and the quick chill mode by operation of the switch corresponding to the mode that is to be entered. For example, quick chill mode may be entered directly from snooze mode by operating the quick chill switch. Similarly, snooze mode may be entered directly from quick chill mode by operating the snooze switch.

Figure 7:
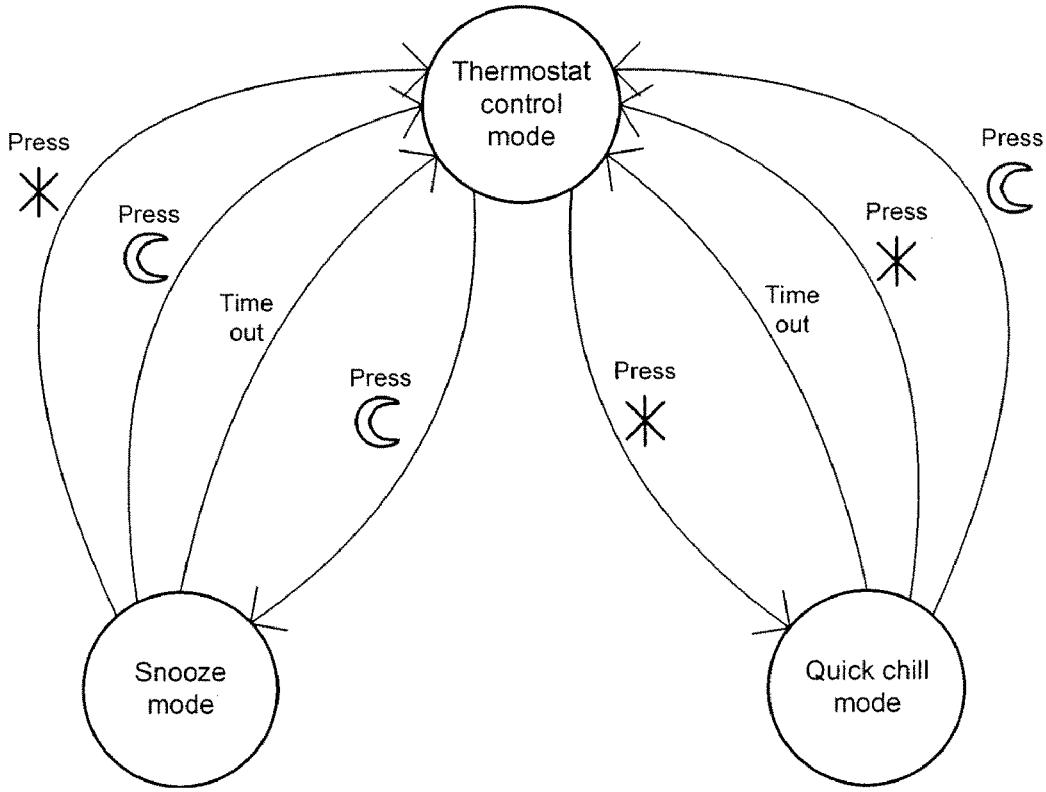
FIG. 7 shows a third state diagram that may be implemented by the control system of FIG. 4.

FIG. 7 shows a third state diagram that may be implemented by the control panel and control logic of FIGS. 3 and 4. This state diagram provides the functionality illustrated in the state diagram of FIG. 5, and adds the additional functionality of terminating the snooze mode or quick chill mode and returning to thermostat control mode by operating the switch corresponding to the opposite function. For example, snooze mode may be terminated by operating the quick chill switch, and quick chill mode may be terminated by operating the snooze switch.

The control panel 30 and control logic circuit 32 of the refrigeration device of FIGS. 3 and 4 may thus provide enhanced user control over operation of the compressor in the form of snooze and quick chill modes that are selectable through user operation of switches on the control panel 30. While FIG. 3 shows the control panel 30 as being located within the interior 10 of the refrigeration device, in alternative embodiments the control panel may be located external to the refrigeration device such as on the door of the refrigeration device or on another outer surface. Also, while FIG. 3 shows the control panel 30 as including status lights LT1, LT2 for indicating the operating mode of the refrigeration device, alternative embodiments may eliminate these lights while retaining the other control system functionality. Further, while it is preferred to provide both a snooze mode and a quick chill mode, alternative embodiments of this refrigeration device may provide only one or the other of these modes through the implementation of appropriate control panel and control logic elements.

Figure 8:
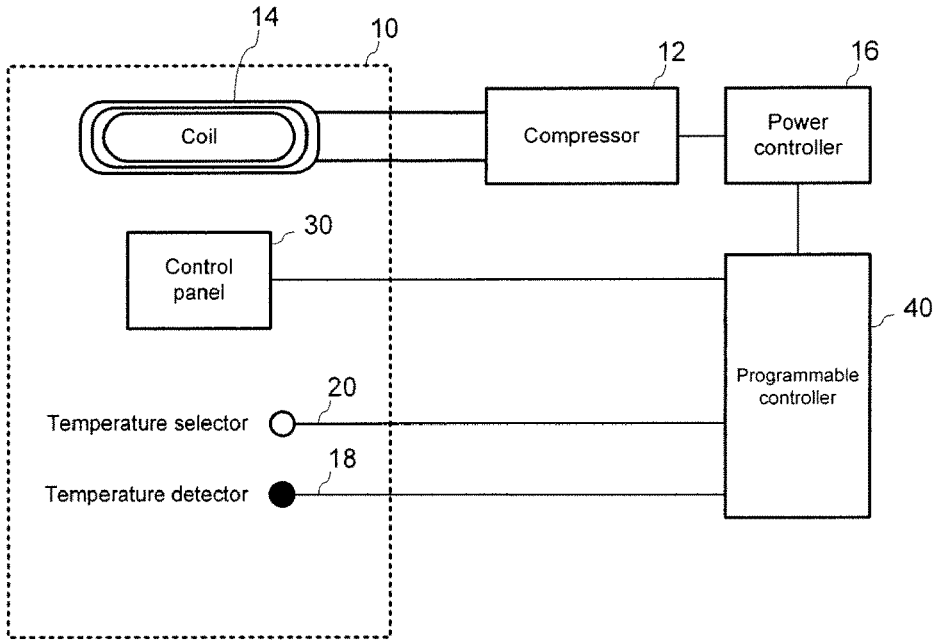
FIG. 8 shows a schematic diagram of a second refrigeration device in accordance with the invention.

FIG. 8 shows a schematic diagram of a second refrigeration device in accordance with the invention. The refrigeration device includes a cooling system comprised of a compressor 12 and coils 14 for cooling the interior space 10 of the refrigeration device. The refrigeration device also includes a control system that is comprised of a temperature detector 18, a temperature selector 20, a control panel 30, and a programmable controller 40 that receives signals from the temperature detector 18 and temperature selector 20. The programmable controller 40 is configured to provide a thermostat control mode, a snooze mode and a quick chill mode.

Figure 9:
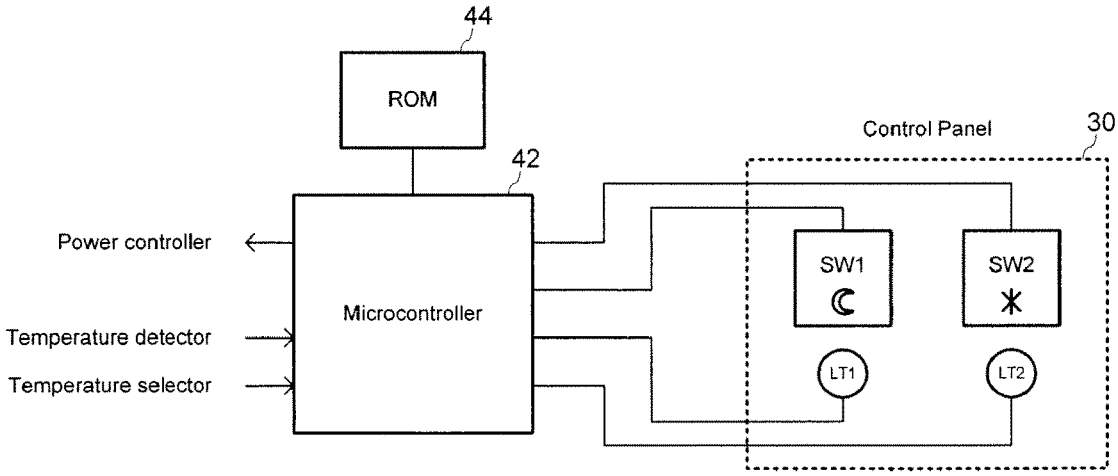
FIG. 9 shows details of a control system of the second refrigeration device.

Details of the control panel 30 and programmable controller 40 are illustrated in FIG. 9. The control panel 30 is similar to that of FIG. 4 and includes a first switch SW1 and a second switch SW2 that are operable by the user to select a snooze mode and a quick chill mode, respectively. Associated with each switch is a respective light LT1, LT2 that indicates the mode in which the refrigeration device is operating. The programmable controller 40 is includes a microcontroller 42 and an associated ROM 44. The microcontroller 42 receives input signals from the switches SW1, SW2, the temperature detector 18 and the temperature selector 20, and provides an output signals to the power controller 16 and to the lights LT1, LT2 or to switches that control the operation of the lights.

The ROM 44 stores appropriate firmware for causing the microcontroller 42 to perform processing that implements control functionality for the refrigeration device. The processing preferably implements the functionality as illustrated in and described with respect to one of the state diagrams of FIG. 5, 6 or 7. In particular, the firmware includes programming for implementing a thermostat control mode based on signals received from the temperature detector and temperature selector, programming for implementing a snooze mode based on the operation of a programmed timing function, programming for implementing a quick chill mode based on the operation of a programmed timing function, programming for initiating, terminating, and switching among these modes in response to inputs received from the control panel, programming for controlling the operation of the lights LT1, LT2, and programming for controlling an output signal supplied to the power controller in accordance with these modes. The microcontroller 42 preferably includes sufficient working memory space for implementing the desired control system functions, however additional memory space may be provided by associating a RAM with the microcontroller 42.

The control panel 30 and programmable controller 40 of the refrigeration device of FIGS. 8 and 9 may thus provide enhanced user control over operation of the compressor in the form of snooze and quick chill modes that are selectable through user operation of switches on the control panel 30. While FIG. 8 shows the control panel 30 as being located within the interior 10 of the refrigeration device, in alternative embodiments the control panel may be located external to the refrigeration device such as on the door of the refrigeration device or on another outer surface. Further, while it is preferred to provide both a snooze mode and a quick chill mode, alternative embodiments of this refrigeration device may provide only one or the other of these modes through the implementation of appropriate control panel elements and microcontroller programming.

In a further alternative embodiment, the control processing shown in FIG. 5, 6 or 7 may be modified to include an additional transition from quick chill mode to thermostat control mode that occurs automatically when a target interior temperature is detected. Such control processing may be used to terminate the quick chill mode in order to prevent excessive chilling, for example, to prevent freezing of objects in the refrigerator compartment of the device. The interior temperature at which the transition occurs may be a predetermined temperature or a user selected temperature. Accordingly, in this alternative embodiment, the quick chill mode will be automatically terminated when the target interior temperature is reached or when the quick chill time period expires.

Figure 10:
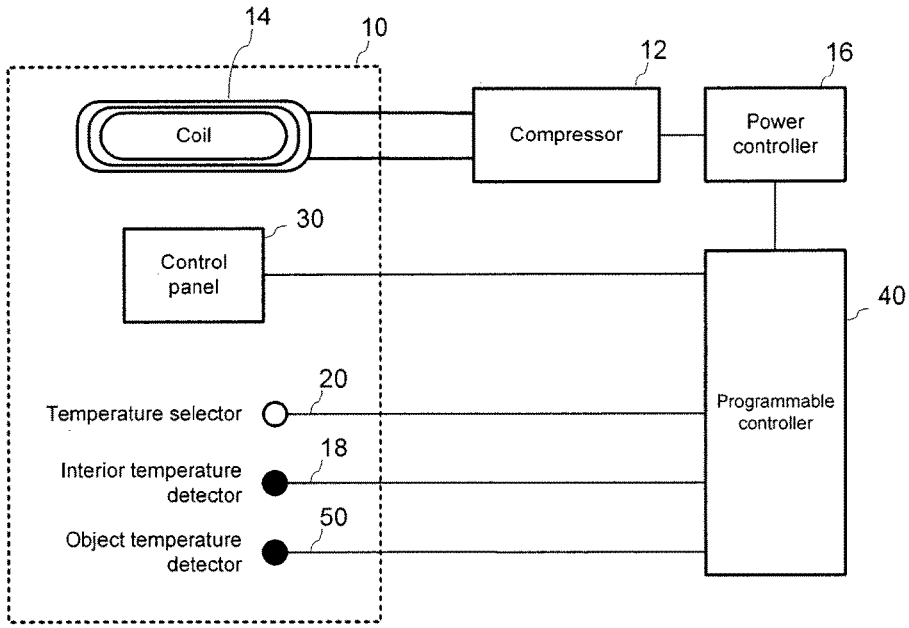
FIG. 10 shows a schematic diagram of a third refrigeration device in accordance with the invention.
Figure 11:
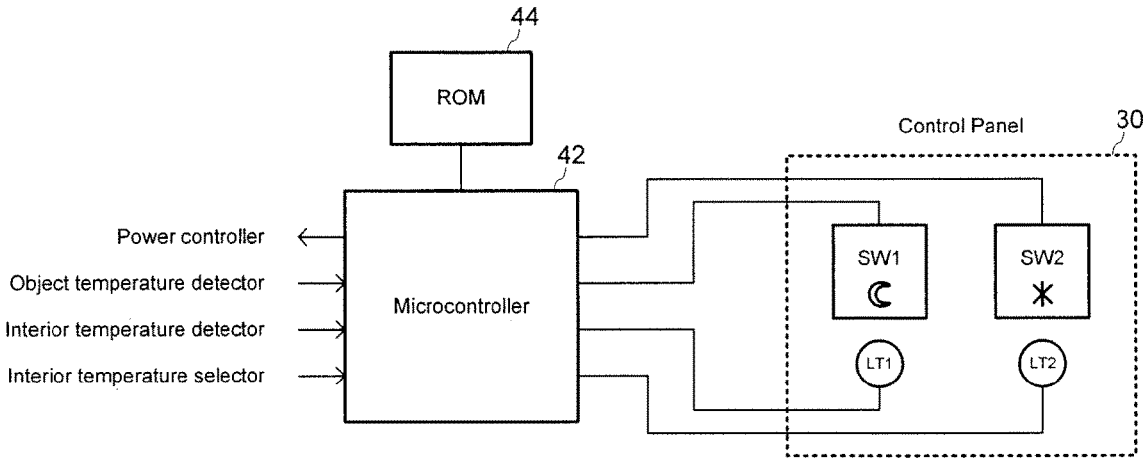
FIG. 11 shows details of a control system of the third refrigeration device.

FIG. 10 shows a schematic diagram of a third refrigeration device in accordance with the invention. This device is similar to that of FIG. 8, but includes an object temperature detector 50 that may be placed in contact with an object in the interior of the refrigeration device to directly measure the temperature of that object. The object temperature detector 50 may be implemented as a thermistor that is provided at the end of a flexible cable, allowing it to be moved into a position of contact with a given object. As shown in FIG. 11, a signal from the object temperature detector 50 is provided as an additional input to the microcontroller 42. Using this input, the microcontroller 42 may perform control processing as illustrated in the state diagram of FIG. 12. This state diagram provides the same functionality as the state diagram of FIG. 6, and adds to that functionality the termination of the quick chill mode and resumption of the thermostat control mode when a target object temperature is reached. In various implementations, the target object temperature may be a predetermined value, or may be derived from the temperature indicated by the temperature selector 20. Further embodiments may provide a separate object temperature selector that enables the user to indicate a target temperature to which the object is to be chilled.

The control panel 30 and programmable controller 40 of the refrigeration device of FIGS. 10 and 11 may thus provide enhanced user control over operation of the compressor in the form of snooze and quick chill modes that are selectable through user operation of switches on the control panel 30, and may terminate the quick chill mode based on the detected temperature of given object. While FIG. 10 shows the control panel 30 as being located within the interior 10 of the refrigeration device, in alternative embodiments the control panel may be located external to the refrigeration device such as on the door of the refrigeration device or on another outer surface. Further, while it is preferred to provide both a snooze mode and a quick chill mode, alternative embodiments of this refrigeration device may provide only the quick chill mode through the implementation of appropriate control panel elements and microcontroller programming.

Figure 12:
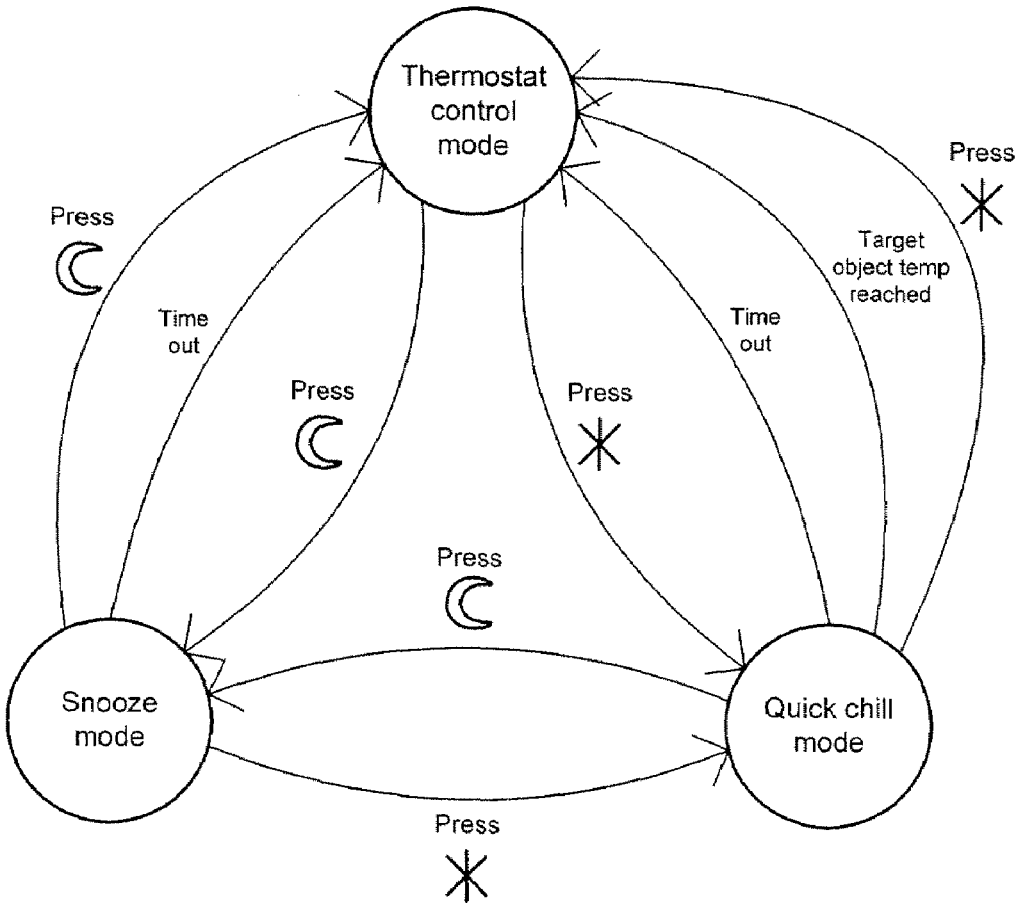
FIG. 12 shows a state diagram that may be implemented by the control system of FIG. 11.

In a further alternative embodiment, the control processing shown in FIG. 12 may be modified to include an additional transition from quick chill mode to thermostat control mode that occurs automatically when a target interior temperature is detected. Such control processing may be used to terminate the quick chill mode in order to prevent excessive chilling, for example, to prevent freezing of objects in the refrigerator compartment of the device. The interior temperature at which the transition occurs may be a predetermined temperature or a user selected temperature. Accordingly, in this alternative embodiment, the quick chill mode will be automatically terminated when the target object temperature is reached, or the target interior temperature is reached, or the quick chill time period expires.

Figure 13:
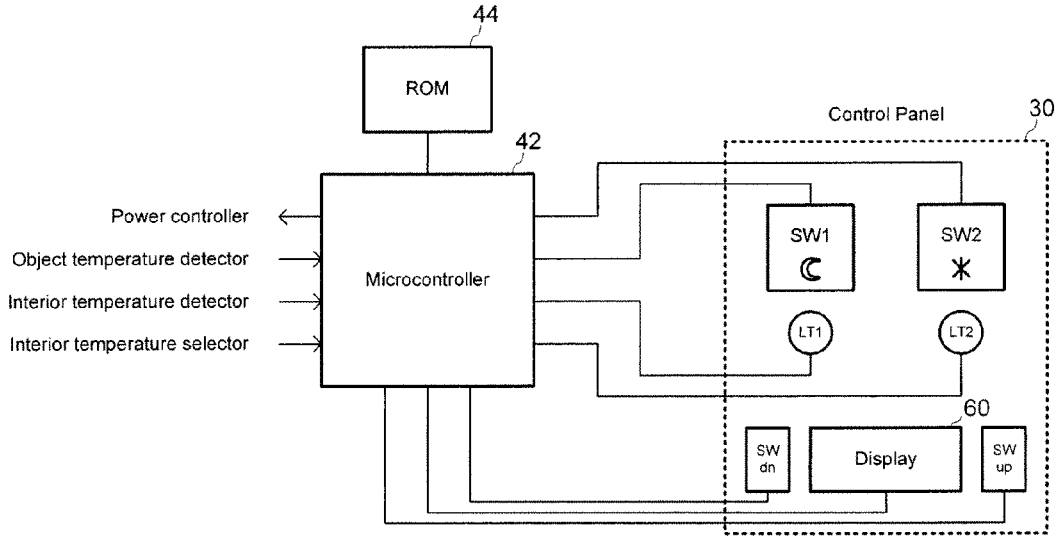
FIG. 13 shows details of an alternative control system of the third refrigeration device.

FIG. 13 shows details of the control panel 30 and programmable controller of a fourth refrigeration device in accordance with the invention. This device is similar to that of FIGS. 10 and 11, but includes a display 60 that is controlled by the microcontroller 42. The display 60 may be an LED display or an LCD display. The microcontroller 42 controls the display 60 to display a current timer value associated with the snooze mode or the quick chill mode when the refrigeration device is operating in one of those modes. For example, upon initiation of the snooze mode, the display may display 8:00, indicating that eight hours of snooze mode remain, and the displayed time may then be decremented to continuously indicate the remaining time.

Associated with the display 60 are a down switch SWdn and an up switch SWup. These switches supply signals to the microcontroller 42 that indicate an increase or reduction of the displayed timer value. In this manner the user may adjust the amount of time to be spent in either the snooze mode or the quick chill mode. For example, after initiation of the snooze mode, the user may operate the down button to reduce the amount of remaining snooze mode time from eight hours to four hours. The signals from the switch are received by the microcontroller 42, where the microcontroller firmware performs a corresponding adjustment on the timing loop that controls the duration of the snooze mode. The reduction of the value of this loop is reflected in the updated value displayed on the display 60.

The control panel 30 and programmable controller 40 of the refrigeration device of FIG. 13 may thus provide enhanced user control over operation of the compressor in the form of snooze and quick chill modes that are selectable through user operation of switches on the control panel 30, and through user control of the amount of time to be spent in either the snooze mode or the quick chill mode. The control panel 30 may be located within the interior 10 of the refrigeration device or external to the refrigeration device such as on the door or another outer surface. While the embodiment of FIG. 13 includes an object temperature detector and may perform control processing in accordance with the signal supplied by that detector, alternative embodiments may implement the display 60 and switches of FIG. 13 without the object temperature detector, and may perform alternative processing such as that of FIG. 5, 6 or 7. Further, while it is preferred to provide both a snooze mode and a quick chill mode, alternative embodiments of this refrigeration device may provide only one or the other of these modes through the implementation of appropriate control panel elements and microcontroller programming. Further alternatives may implement the display and associated switches of FIG. 13 in an embodiment using discrete logic elements, an integrated circuit or a hybrid circuit as described with respect to FIG. 4.

In a further alternative embodiment, the control processing shown in FIG. 5, 6, 7 or 12 may be modified to include an additional transition from the quick chill mode to the thermostat control mode that occurs automatically when a target interior temperature is detected. Such control processing may be used to terminate the quick chill mode in order to prevent excessive chilling, for example, to prevent freezing of objects in the refrigerator compartment of the device. The interior temperature at which the transition occurs may be a predetermined temperature or a user selected temperature.

Figure 14:
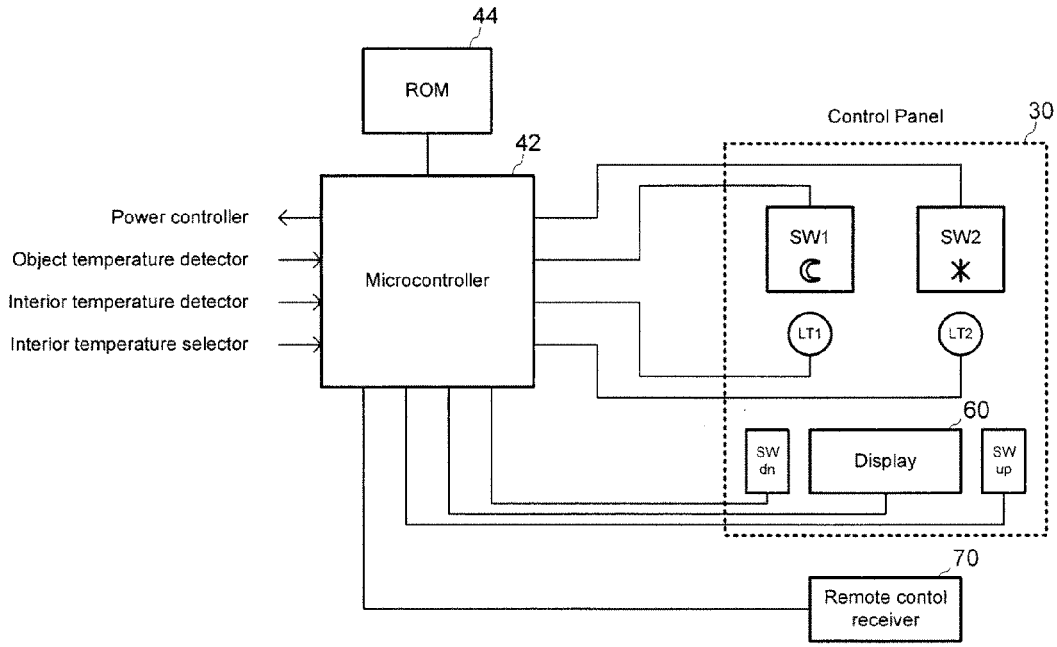
FIG. 14 shows details of another alternative control system of the third refrigeration device.

FIG. 14 shows details of the control panel 30 and programmable controller of a fifth refrigeration device in accordance with the invention. This device is similar to that of FIGS. 10 and 13, but includes a remote control receiver 70 for receiving signals generated by a remote control. The remote control receiver 70 may be implemented as an infrared signal receiver. In this embodiment, the microcontroller firmware includes programming for recognizing control signals received via the remote control receiver 70 and for responding to the control signals. Control signals that may be recognized by the microcontroller 42 include signals corresponding to operation of the snooze and quick chill switches, as well as signals corresponding to operation of the up and down switches. The recognition and processing of these signals enables the control panel functions of the refrigeration device to be performed by a user from a distance using a remote control device. For example, in the case of a hotel room refrigerator, the user may place the refrigerator in snooze mode while lying in bed by operating a snooze button of the remote control.

The control panel 30 and programmable controller 40 of the refrigeration device of FIG. 14 may thus provide enhanced user control over operation of the compressor in the form of snooze and quick chill modes that are selectable through user operation of switches on the control panel 30 or user operation of a remote control, and through user control of the amount of time to be spent in either the snooze mode or the quick chill mode. The control panel 30 may be located within the interior 10 of the refrigeration device or external to the refrigeration device such as on the refrigerator door or another external surface. While the embodiment of FIG. 14 includes an object temperature detector and may perform control processing in accordance with the signal supplied by that detector, alternative embodiments may implement the display 60, switches and remote control receiver 70 of FIG. 14 without the object temperature detector, and may perform alternative processing such as that of FIG. 5, 6 or 7. Further, while it is preferred to provide both a snooze mode and a quick chill mode, alternative embodiments of this refrigeration device may provide only one or the other of these modes through the implementation of appropriate control panel or remote control elements and microcontroller programming. Further alternatives may be implemented without the switch elements of the control panel, instead using only the remote control to provide user input.

In a further alternative embodiment, the control processing shown in FIG. 5, 6, 7 or 12 may be modified to include an additional transition from the quick chill mode to the thermostat control mode that occurs automatically when a target interior temperature is detected. Such control processing may be used to terminate the quick chill mode in order to prevent excessive chilling, for example, to prevent freezing of objects in the refrigerator compartment of the device. The interior temperature at which the transition occurs may be a predetermined temperature or a user selected temperature.

Figure 15:
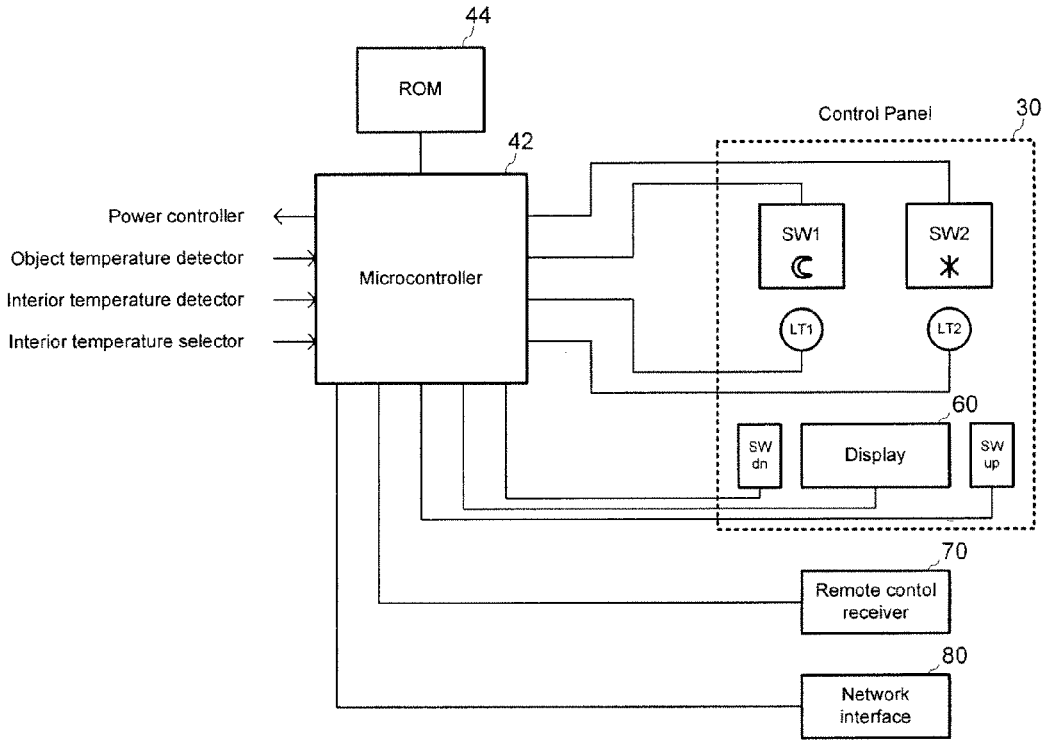
FIG. 15 shows details of another alternative control system of the third refrigeration device.

FIG. 15 shows details of the control panel 30 and programmable of a sixth refrigeration device in accordance with the invention. This device is similar to that of FIGS. 10 and 14, but includes a network interface 80 for receiving communications over a network. The network interface 80 may be implemented as a wired network interface such as an Ethernet interface, or a wireless network interface such as a WiFi interface. In this embodiment, the microcontroller firmware includes programming for receiving and sending communications over the network, and for recognizing control commands received over the network. Control commands that may be recognized by the microcontroller include commands corresponding to operation of the snooze and quick chill switches, as well as commands corresponding to operation of the up and down switches. The recognition and processing of these commands enables the control panel functions of the refrigeration device to be operated by a user from a distance over a network. For example, in the case of a hotel room refrigerator, an employee at the reservation desk may place the refrigerator into thermostat control mode upon guest check-out, or may place the refrigerator into quick chill mode upon guest check-in, by transmitting appropriate commands addressed to the network interface of the refrigerator through a communications network to which the network interface 80 is connected.

The control panel 30 and programmable controller 40 of the refrigeration device of FIG. 15 may thus provide enhanced user control over operation of the compressor in the form of snooze and quick chill modes that are selectable through user operation of switches on the control panel 30 or user operation of a remote control or user commands sent over a network, and through user control of the amount of time to be spent in either the snooze mode or the quick chill mode. The control panel 30 may be located within the interior 10 of the refrigeration device or external to the refrigeration device such as on the refrigerator door or another outer surface. While the embodiment of FIG. 14 includes an object temperature detector and may perform control processing in accordance with the signal supplied by that detector, alternative embodiments may implement the display 60, switches, remote control receiver 70 and network interface 80 of FIG. 15 without the object temperature detector, and may perform alternative processing such as that of FIG. 5, 6 or 7. Further, while it is preferred to provide both a snooze mode and a quick chill mode, alternative embodiments of this refrigeration device may provide only one or the other of these modes through the implementation of appropriate control panel or remote control elements and microcontroller programming. Further alternatives may be implemented without the switch elements of control panel, or without the remote control interface, or without both.

In a further alternative embodiment, the control processing shown in FIG. 5, 6, 7 or 12 may be modified to include an additional transition from the quick chill mode to the thermostat control mode that occurs automatically when a target interior temperature is detected. Such control processing may be used to terminate the quick chill mode in order to prevent excessive chilling, for example, to prevent freezing of objects in the refrigerator compartment of the device. The interior temperature at which the transition occurs may be a predetermined temperature or a user selected temperature.

The circuits, devices, processes and features described herein are not exclusive of other circuits, devices, processes and features, and variations and additions may be implemented in accordance with the particular objectives to be achieved. For example, devices and processes as described herein may be integrated or interoperable with other devices and processes not described herein to provide further combinations of features, to operate concurrently within the same devices, or to serve other purposes. Thus it should be understood that the embodiments illustrated in the figures and described above are offered by way of example only. The invention is not limited to a particular embodiment, but extends to the various modifications, combinations, and permutations that will be apparent from this disclosure to those having ordinary skill in the art.

What is claimed is:

1. A refrigeration device comprising:

a control system for controlling a compressor of the refrigeration device, the control system being switchable among at least three states in response to user commands, the three states including a thermostat control state in which the compressor is turned on and off to maintain an interior of the refrigeration device near a target temperature, an off state in which the compressor is maintained continuously off for a first predetermined period of time, and an on state in which the compressor is maintained continuously on for a second predetermined period of time:

wherein the control system comprises a control logic circuit providing a control signal for controlling a state of the compressor;

a temperature detector located in the interior of the refrigeration device the temperature detector providing a temperature detector signal to the control logic circuit:

a control panel including a first switch corresponding to the off state and a second switch corresponding to the on state, the first switch and the second switch providing respective signals to the control logic circuit;

wherein operation of the first switch corresponding to the off state during the thermostat control state causes the control system to enter the off state for the first predetermined period of time, wherein operation of the first switch corresponding to the off state during the off state causes the control system to enter the thermostat control state, wherein operation of the second switch corresponding to the on state during the thermostat control state causes the control system to enter the on state for the second predetermined period of time, wherein operation of the second switch corresponding to the on state during the on state causes the control system to enter the thermostat control, wherein operation of the first switch corresponding to the off state during the on state causes the control system to enter the off state, and wherein operation of the second switch corresponding the on state during the off state causes the control system to enter the on state.

2. The device claimed in claim 1, wherein the control system reverts from the off state to the thermostat controlled state after expiration of the first predetermined period of time.

3. The device claimed in claim 1, wherein the control system reverts from the on state to the thermostat controlled state after expiration of the second predetermined period of time.

4. The device claimed in claim 1, wherein the control panel is located in the interior of the refrigeration device.

5. The device claimed in claim 1, wherein the control panel is located at the exterior of the refrigeration device.

6. The device claimed in claim 1, wherein the control panel further comprises a first indicator light associated with the first switch and a second indicator light associated with the second switch, and wherein the control logic circuit supplies a signal to illuminate the first indicator light when the control system is in the off state, and supplies a signal to illuminate the second indicator light when the control system is in the on state.

7. The device claimed in claim 1, wherein the control logic circuit comprises a switching logic circuit and a timer logic circuit.

8. The device claimed in claim 1, wherein the control system comprises:

a programmable controller providing a control signal for controlling the state of the compressor;

a temperature detector providing a signal to the programmable controller as a representative of interior temperature of the refrigeration device;

a temperature selector providing a signal to a microcontroller as a representative of an target temperature for the thermostat control mode; and wherein the first switch and the second switch provide respective signals to the programmable controller.

9. The device claimed in claim 8, wherein the programmable controller comprises a microcontroller and a ROM storing programming code for causing the microcontroller to execute processing that comprises, in response to a user command, maintaining the compressor in the off state for the first predetermined period of time.

10. The device claimed in claim 8, wherein the programmable controller comprises a microcontroller and a ROM storing programming code for causing the microcontroller to execute processing that comprises, in response to a user command, maintaining the compressor in the on state for the second predetermined period of time.

11. The device claimed in claim 10, wherein the programming code further causes the microcontroller to execute processing that comprises terminating the on state if the detected interior temperature of the refrigeration device falls below a predetermined temperature.

12. The device claimed in claim 8, wherein the control panel further comprises a display for displaying a remaining amount of time that the compressor will be maintained in the on state or the off state and one or more switches for adjusting a remaining amount of time.

13. The device claimed in claim 8, wherein the control system further comprises a remote control receiver for providing a signal to the programmable controller, the signal representing a command transmitted from a remote control device, and wherein the control system is switchable among the thermostat control state, the on state and the off state in response to user commands received through the remote control receiver.

14. The device claimed in claim 13, wherein the remote control receiver is includes an infrared sensor.

15. The device claimed in claim 8, wherein the control system further comprises a network interface providing a signal to the programmable controller, the signal being received through a communications network, wherein the control system is switchable among the thermostat control state, the on state and the off state in response to user commands received through the network interface.

16. A refrigeration device comprising:

a control system for controlling a compressor of the refrigeration device, the control system being switchable among at least three states in response to user commands, the three states including a thermostat control state in which the compressor is turned on and off to maintain an interior of the refrigeration device near a target temperature, an off state in which the compressor is maintained continuously off for a first predetermined period of time, and an on state in which the compressor is maintained continuously on for a second predetermined period of time;

wherein the control system comprises a control logic circuit providing a control signal for controlling a state of the compressor;

a temperature detector located in the interior of the refrigeration device the temperature detector providing a temperature detector signal to the control logic circuit;

a control panel comprising a first switch corresponding to the off state and a second switch corresponding to the on state, the first switch and the second switch providing respective signals to the control logic circuit;

wherein operation of the first switch corresponding to the off state during the thermostat control state causes the control system to enter the off state for the first predetermined period of time, wherein operation of the first switch corresponding to the off state during the off state causes the control system to enter the thermostat control state, wherein operation of the second switch corresponding to the on state during the thermostat control state causes the control system to enter the on state for the second predetermined period of time, wherein operation of the second switch corresponding to the on state during the on state causes the control system to enter the thermostat control, wherein operation of the first switch corresponding to the off state during the on state causes the control system to enter the thermostat control state, and wherein operation of the second switch corresponding to the on state during the off state causes the control system to enter the thermostat control state.

* * * * *